United States Patent [19]

Ritter

[11] Patent Number: 5,065,937

[45] Date of Patent: Nov. 19, 1991

[54] CONTAINER WITH END WALL OPENING FOR HANDLE ACCESS

[75] Inventor: Karl M. Ritter, Carol Stream, Ill.

[73] Assignee: Container Corporation of America, Clayton, Mo.

[21] Appl. No.: 645,704

[22] Filed: Jan. 25, 1991

[51] Int. Cl.[5] ..... B65D 5/10

[52] U.S. Cl. ..... 229/117.13; 229/120.18; 229/131.1; 206/193; 206/200

[58] Field of Search ..... 229/117.13, 120.14, 229/120.15, 120.18, 131.1; 206/175, 193, 200, 166

[56] References Cited

U.S. PATENT DOCUMENTS

| | | | |
|---|---|---|---|
| 2,630,264 | 3/1953 | Holy | 229/117.13 |
| 2,685,999 | 8/1954 | Forrer | 229/120.18 |
| 2,748,978 | 6/1956 | Hennessey et al. | 206/166 |
| 3,065,876 | 11/1962 | Gioia | 206/166 |
| 3,116,851 | 1/1964 | Lemon | 206/166 |
| 3,554,402 | 1/1971 | Lock | 206/193 |
| 3,747,801 | 7/1973 | Graser | 206/200 |
| 4,293,091 | 10/1981 | Gerard | 229/120.18 |
| 4,327,829 | 5/1982 | Hughes | 229/117.13 |
| 4,493,415 | 1/1985 | Wood | 206/175 |
| 4,817,866 | 4/1989 | Wonnacott | 206/427 |

FOREIGN PATENT DOCUMENTS

| | | | |
|---|---|---|---|
| 0586398 | 12/1957 | Canada | 229/52 B |
| 2086850 | 5/1982 | United Kingdom | 229/120.18 |

*Primary Examiner*—Stephen Marcus
*Assistant Examiner*—Christopher McDonald
*Attorney, Agent, or Firm*—Richard W. Carpenter

[57] ABSTRACT

A container formed from a unitary blank of foldable paperboard that has an internal divider panel, with an integral handle at one end thereof, and that has an end wall formed by pairs of overlapping end closure flaps that are recessed to form a common opening affording access to the internal handle.

8 Claims, 2 Drawing Sheets

CONTAINER WITH END WALL OPENING FOR HANDLE ACCESS

BACKGROUND OF THE INVENTION

1. Field of the Invention:

This invention relates to containers of the type having an internal divider with integral handle, and more particularly to a container having an end wall with an opening affording access to the internal handle.

2. Description of Background Art:

A background art search directed to the subject matter of this application conducted in the United States Patent and Trademark Office disclosed the following U.S. Letters Patent:

| | | | |
|---|---|---|---|
| 1,737,950 | 1,898,231 | 2,097,941 | 2,442,699 |
| 2,694,596 | 2,696,400 | 2,711,922 | 2,881,946 |
| 2,942,756 | 2,998,179 | 3,145,835 | 3,954,220 |
| 4,293,091 | 4,398,661 | 4,530,460 | |

None of the patents uncovered in the search discloses a shipping container having an internal divider panel with an integral handle at one end thereof and having an end wall formed by pairs of overlapping end closure flaps that are recessed to form a common opening affording access to the internal handle.

SUMMARY OF THE INVENTION

An object of the invention to provide a shipping container having an internal partition dividing the container into two or more compartments and which has an integral handle at one end.

A more specific object of the invention is to provide a container of the type described, wherein the upper end wall is formed of overlapping closure flaps secured to each other and which have recesses that form a common opening affording access to the handle of the container while the end flaps are still secured to each other in closed condition.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 2:
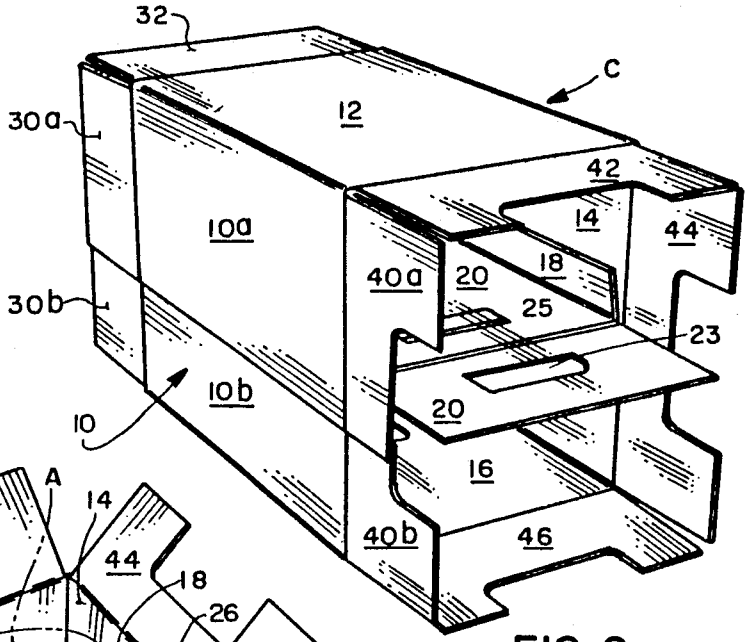
FIGS. 2 and 3 are fragmentary perspective views similar to that of FIG. 1, but illustrating separate steps in the erection of the container and closure of the end walls.
Figure 3:
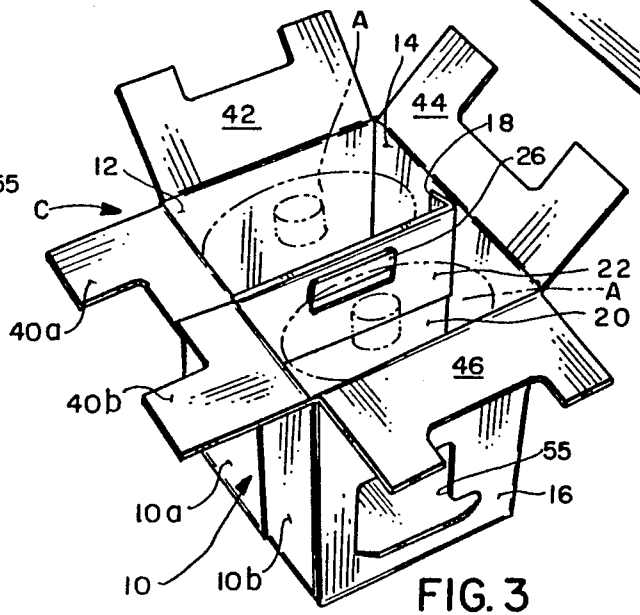
Figure 1:
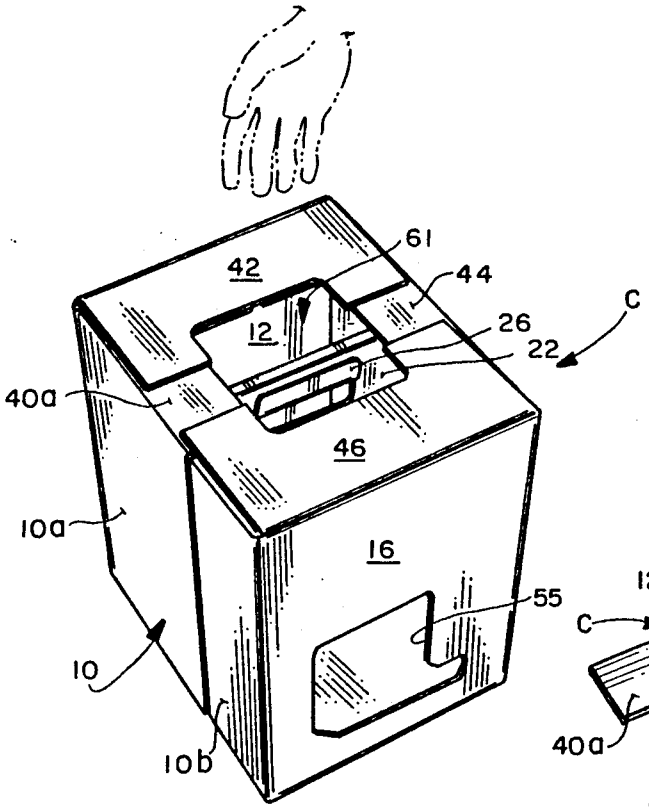
FIG. 1 is a fragmentary perspective view, as seen from above, of a container embodying features of the present invention shown in the closed condition.
Figure 4:
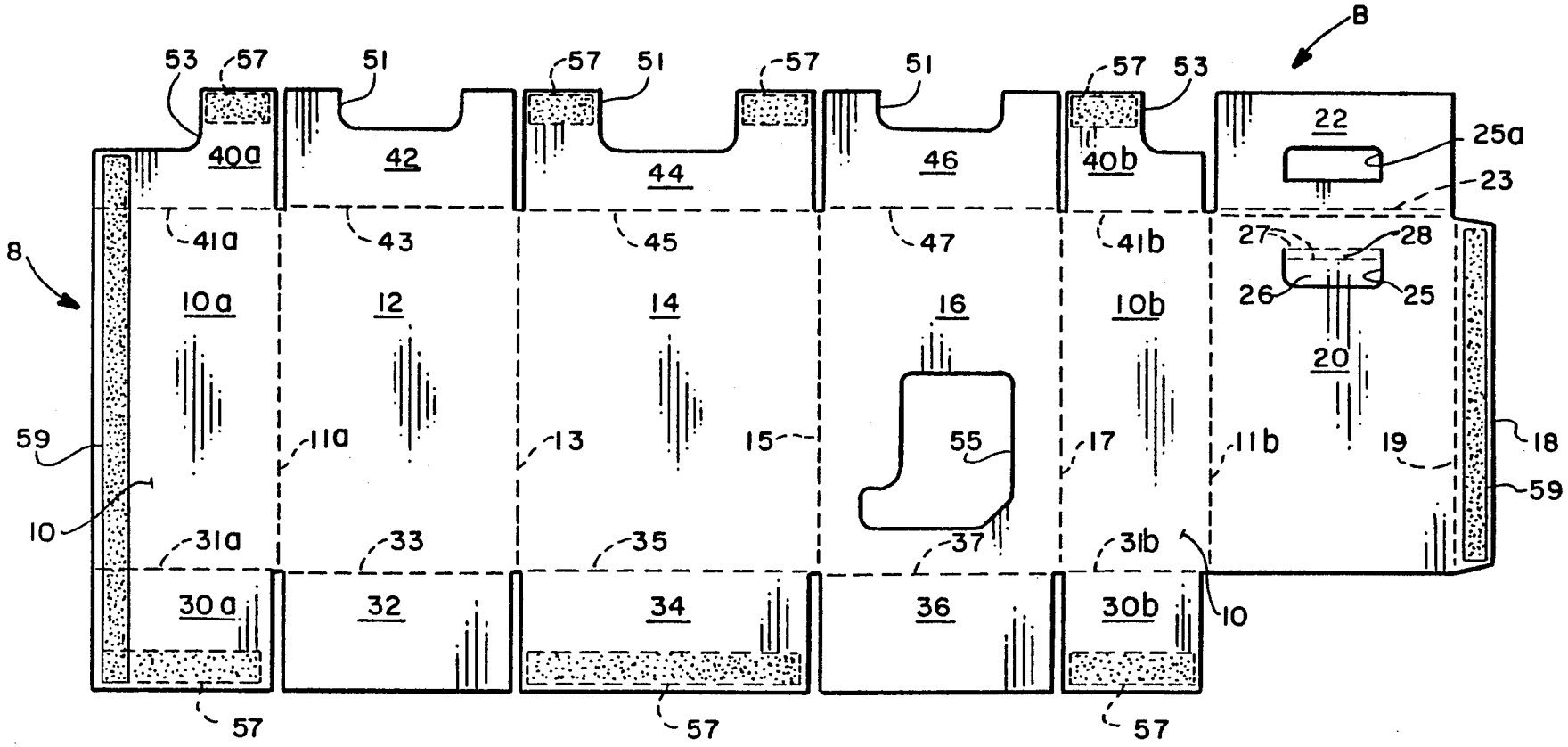
FIG. 4 is a fragmentary plan view of a blank of foldable sheet material from which the container illustrated in the other views may be formed.

Referring now to the drawings for a better understanding of the invention, it will be seen that the compartmented container C illustrated in FIGS. 1-3 may be formed from the unitary blank B of foldable sheet material, such as paperboard, illustrated illustrated in FIG. 4.

As best seen in FIGS. 1 and 3, container C is a compartmented container adapted to hold two or more relatively heavy articles A, such as bottles of detergent or the like.

The purpose of the invention is to provide a container with an internal handle and with a top end wall having an access opening large enough to enable a person to reach into the container with a hand and grasp the handle and lift the container while the container top end wall is still in a closed condition, as illustrated in FIG. 1.

As best seen in FIG. 4, the central portion or body 8 of the container comprises a first side wall panel first section 10*a*, a second side wall panel 12, a third side wall panel 14, a fourth side wall panel 16, a first side wall panel second section 10*b*, a divider panel 20, and a glue panel 18, that are foldably joined to each other along parallel fold lines 11*a*, 13, 15, 17, 11*b*, and 19, respectively, which extend transversely of blank B.

As best seen in FIGS. 2 and 3, first side wall 10 comprises a pair of overlapping first and second side wall panel sections 10*a* and 10*b*, respectively, which are secured to each other in overlapped relation.

The container is divided into separate compartments by the divider panel 20 which extends between and is foldably joined to opposed side walls 10 and 14. Divider panel 20 is joined to the side wall 10 along the fold line 11*b*, which joins the divider panel to first side wall panel second section 10*b*, and is joined to the opposite side wall 14 along the fold line 19, which joins the divider panel to a glue panel 18, which in turn is adhesively secured to side wall panel 14 in a manner hereinafter described.

As best seen in FIGS. 2 and 4, a handle panel 22 is foldably joined, along a preferably double fold line 23, to the upper end edge of divider panel 20. Handle panel 20 is adapted to be folded over 180 degrees to lie against an upper portion of divider panel 20 to provide a strong two-ply handle structure.

Divider panel 20 and handle panel 22 are provided with aligned hand receiving openings 25 and 25*a*, respectively. Divider panel 20 may also be provided in the area of opening 25 with a flap 26 which is foldably joined to the handle panel along a pair of score lines 27 that are spaced from each other to provide a relatively narrow elongated strip 28 therebetween.

When the handle panel 22 has been folded into overlapping relation with the divider panel 20, the flap 26 is pushed out of the plane of the divider panel 20 and folded approximately 180 degrees to overlie the handle panel adjacent its opening 25*a*. This makes it more comfortable for one to grasp and lift the container by the handle.

Again referring to FIG. 4, it will be seen that bottom end closure flaps 30*a*, 32, 34, 36, and 30*b* are foldably joined to the lower edges of panels 10*a*, 12, 14, 16, and 10*b* along fold lines 31*a*, 33, 35, 37, and 31*b*. respectively. These flaps may be folded 90 degrees into overlapping relation and secured to each other to close the lower end of the container.

At the upper end of the container body B, there are provided top closure flaps 40*a*, 42, 44, 46, and 40*b*, which are foldably joined to the upper end edges of side wall panels 10*a*, 12, 14, 16, and 10*b* on fold lines 41*a*, 43, 45, 47, and 41*b*, respectively.

Top closure flaps 42, 44, and 46 are generally U-shaped and have central recesses 51 in the outer edges thereof arranged to cooperate with related recesses 53 in upper closure flaps 40*a* and 40*b* to form a hand receiving opening 61, as seen in FIG. 1. The opening 61 affords access to the internal handle when the container is closed with the top closure flaps secured to each other in overlapped relationship.

Both the upper and lower closure flaps are provided with adhesive, indicated at 57, to permit them to be secured to each other in overlapping relationship to close opposite ends of the container. Also, panels 10*a* and 18 may be provided with adhesive indicated at 59 to permit the ends of the blank to be secured to each other to form the tubular structure which represents the body 8 of the container.

If desired, one or more side walls may be provided with an opening extending therethrough, such as opening 55 in side wall 16, to accomodate viewing the contents of the container.

Thus, it will be understood that the invention provides a container of relatively simple design and construction which is compartmentalized to hold a pair of heavy articles, and which has an internal handle that may be grasped through an opening in the upper wall of the container, so the upper wall can be left intact until it is opened to remove the articles from the container.

What is claimed is:

1. A one-piece container having an internal divider panel, with an integral handle at one end thereof, and having an end wall with an opening affording access to said handle, said container being formed from a unitary blank of foldable paperboard, and comprising:

(a) pairs of opposed side walls foldably interconnected on parallel fold lines to form a tubular structure open at its upper and lower ends;

(b) an internal divider panel extending between and having opposite side edges foldably joined to the respective side walls of one of said pairs on fold lines that extend parallel to said last mentioned fold lines;

(c) said divider panel having foldably joined to an upper end edge thereof a handle panel adapted to be folded 180 degrees into overlapping relation with a portion of said divider panel to form therewith a two-ply handle with an upper extremity that does not, at any time, extend above any of said side walls;

(d) top and bottom end closure flaps foldably joined to upper and lower end edges, respectively, of said side walls and adapted to be folded inwardly 90 degrees and secured to each other in overlapping relation to form end walls for closing, at least partially, the ends of said structure;

(e) certain of said top closure flaps being U-shaped and being arranged and disposed for cooperation with each other to form, when said top flaps are closed, a central opening large enough to accommodate the entry of a hand to enable one to reach into the container and grasp the handle and lift the container.

2. A container according to claim 1, wherein one of said side walls includes a pair of overlapping first and second panel sections adhesively secured to each other, and wherein said second panel section is foldably joined to said divider panel.

3. A container according to claim 1, wherein said divider panel has a pair of overlapping panel sections of one of said side walls and has an opposite side edge foldably joined to a glue panel that is adhesively secured to another of said side walls.

4. A one-piece container having an internal divider panel, with an integral handle at one end thereof, and having an end wall with an opening affording access to said handle, said container being formed from a unitary blank of foldable paperboard, and comprising:

(a) pairs of opposed side walls foldably interconnected on parallel fold lines to form a tubular structure open at its upper and lower ends;

(b) an internal divider panel extending between and having opposite side edges foldably joined to the respective side walls of one of said pairs on fold lines that extend parallel to said last mentioned fold lines;

(c) said divider panel having, at its upper end, a handle, with an upper extremity that does not, at any time, extend above any of said side walls;

(d) top and bottom end closure flaps foldably joined to upper and lower end edges, respectively, of said side walls and adapted to be folded inwardly 90 degrees and secured to each other in overlapping relation to form end walls for closing, at least partially, the ends of said structure;

(e) certain of said top closure flaps being U-shaped and being arranged and disposed for cooperation with each other to form, when said top flaps are closed, a central opening large enough to accomodate the entry of a hand to enable one to reach into the container and grasp the handle and lift the container.

5. A container according to claim 4, wherein said divider panel has, foldably joined to an upper end edge thereof, a handle panel adapted to be folded 180 degrees into overlapping relation with said divider panel and having a hand receiving opening arranged and disposed for alignment with a related opening in said divider panel to form said handle.

6. A container according to claim 4 wherein certain of said top closure flaps are U-shaped.

7. A container according to claim 4, wherein one of said side walls includes a pair of overlapping first and second panel sections adhesively secured to each other, and wherein said second panel section is foldably joined to said divider panel.

8. A container according to claim 4, wherein said divider panel has one side edge foldably joined to one of said side walls and has an opposite side edge foldably joined to a glue panel that is adhesively secured to of another of said side walls.

* * * * *